US007721881B2

(12) United States Patent
He

(10) Patent No.: US 7,721,881 B2
(45) Date of Patent: May 25, 2010

(54) CIGARETTE CASE WITH CIGARETTE EJECTION MECHANISM

(76) Inventor: Wentian He, 4C, No. 2, Baihui Commercial Center, Songbaitang, Changpin, Dongguan, Gusngdong (CN) 523561

( * ) Notice: Subject to any disclaimer, the term of this patent is extended or adjusted under 35 U.S.C. 154(b) by 315 days.

(21) Appl. No.: 11/874,189

(22) Filed: Oct. 17, 2007

(65) Prior Publication Data

US 2008/0185303 A1 Aug. 7, 2008

(30) Foreign Application Priority Data

Feb. 6, 2007 (CN) ..... 2007 1 0073214

(51) Int. Cl.
*A24F 15/00* (2006.01)
*A24F 15/14* (2006.01)

(52) U.S. Cl. ..... 206/249; 206/252; 206/255

(58) Field of Classification Search ..... 206/249–255, 206/266, 804, 817; 221/248, 208, 224, 247, 221/250, 271
See application file for complete search history.

(56) References Cited

U.S. PATENT DOCUMENTS 1,408,464 A * 3/1922 Moeller ..... 221/232
1,825,805 A * 10/1931 Markson ..... 221/230
1,957,293 A * 5/1934 Reilly ..... 206/250
2,457,966 A * 1/1949 Zaidan ..... 221/250
2,510,630 A * 6/1950 Goldsworthy ..... 206/252
2,519,020 A * 8/1950 Breitwieser ..... 206/252
3,101,157 A * 8/1963 Russell ..... 221/227
3,446,338 A * 5/1969 Bozyk ..... 206/250
5,205,402 A * 4/1993 Maeda ..... 206/250

* cited by examiner

*Primary Examiner*—Mickey Yu
*Assistant Examiner*—Steven A. Reynolds

(57) ABSTRACT

A cigarette case includes an outer casing hingedly secured to a cover; a U-shaped first pusher proximate the other side of the outer casing and including at least one longitudinal groove or arcuate section; a trigger member secured onto the other side of the outer casing; a spring biased hinge-type ejector lid on a top corner of the outer casing; a sliding cross-shaped second pusher; and a sliding V-shaped member resiliently interconnecting the second pusher and the cover. A plurality of cigarettes are contained in a space defined between the first pusher and the second pusher such that pulling up the trigger member a predetermined distance will lift the first pusher to cause the at least one cigarette engaged therewith to open the ejector lid.

9 Claims, 10 Drawing Sheets

CIGARETTE CASE WITH CIGARETTE EJECTION MECHANISM

BACKGROUND OF THE INVENTION

1. Field of Invention

The invention relates to accessories for smoking tobacco, and more particularly to a cigarette case having an improved cigarette ejection mechanism for ejecting one or two cigarettes in a dispensing operation.

2. Description of Related Art

There have been numerous suggestions in prior patents for ejecting a cigarette from a cigarette case. For example, U.S. Pat. No. 5,265,717 discloses a cigarette case for automatically lighting and ejecting a cigarette contained therein. While the '717 patent can accomplish its objective, its gear mechanism and conveyor are relatively complex in constructions, resulting in an increase in the manufacturing cost. Thus, continuing improvements in the exploitation of cigarette case having a simple cigarette ejection mechanism are constantly being sought.

SUMMARY OF THE INVENTION

It is therefore one object of the invention to provide a cigarette case having a cigarette ejection mechanism for ejecting one cigarette in a dispensing operation.

It is another object of the invention to provide a cigarette case having a cigarette ejection mechanism for ejecting two cigarettes in a dispensing operation.

The above and other objects, features and advantages of the invention will become apparent from the following detailed description taken with the accompanying drawings.

DETAILED DESCRIPTION OF THE INVENTION

Figure 1:
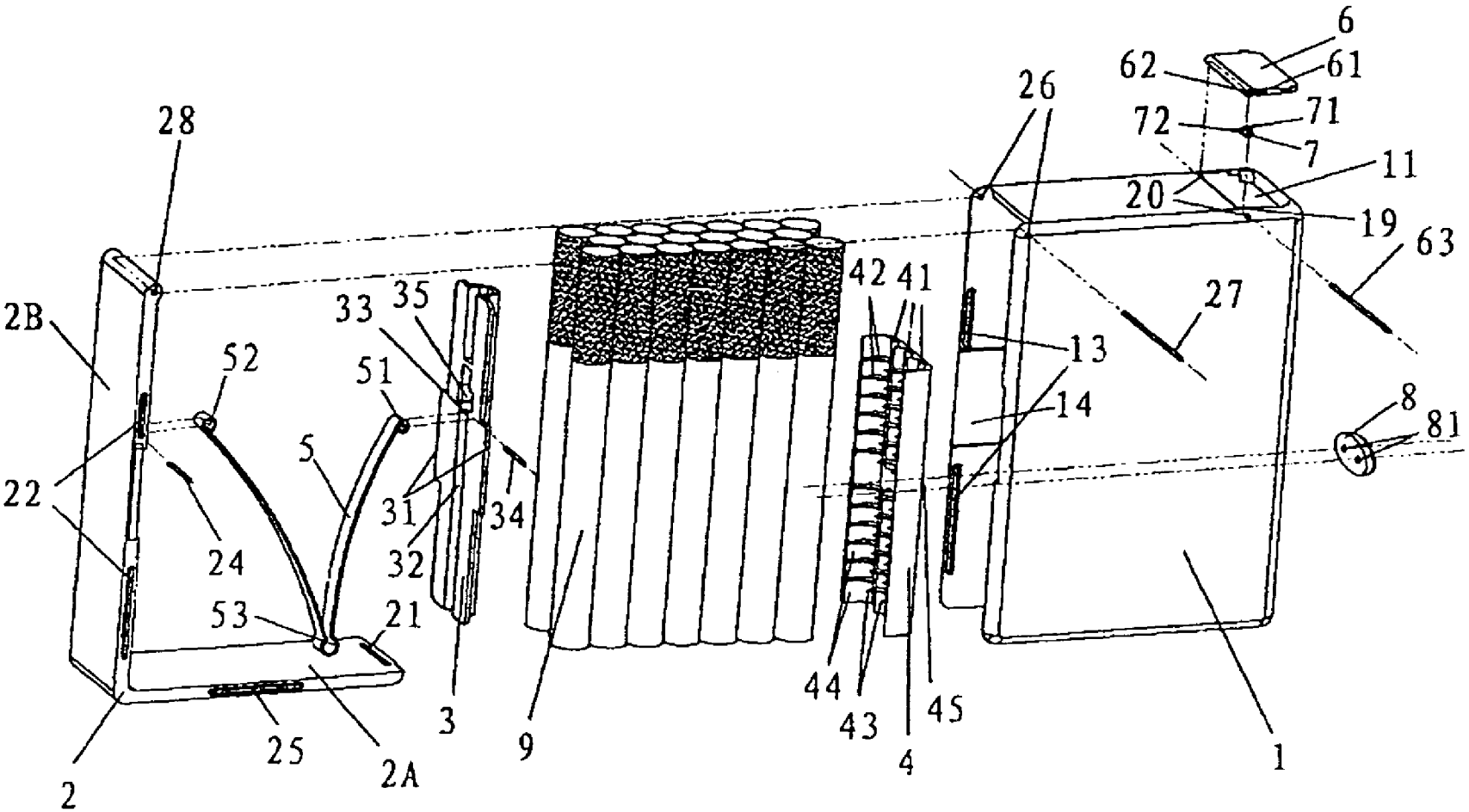
FIG. 1 is an exploded view of cigarette case incorporating a first preferred embodiment of first pusher according to the invention.
Figure 2:
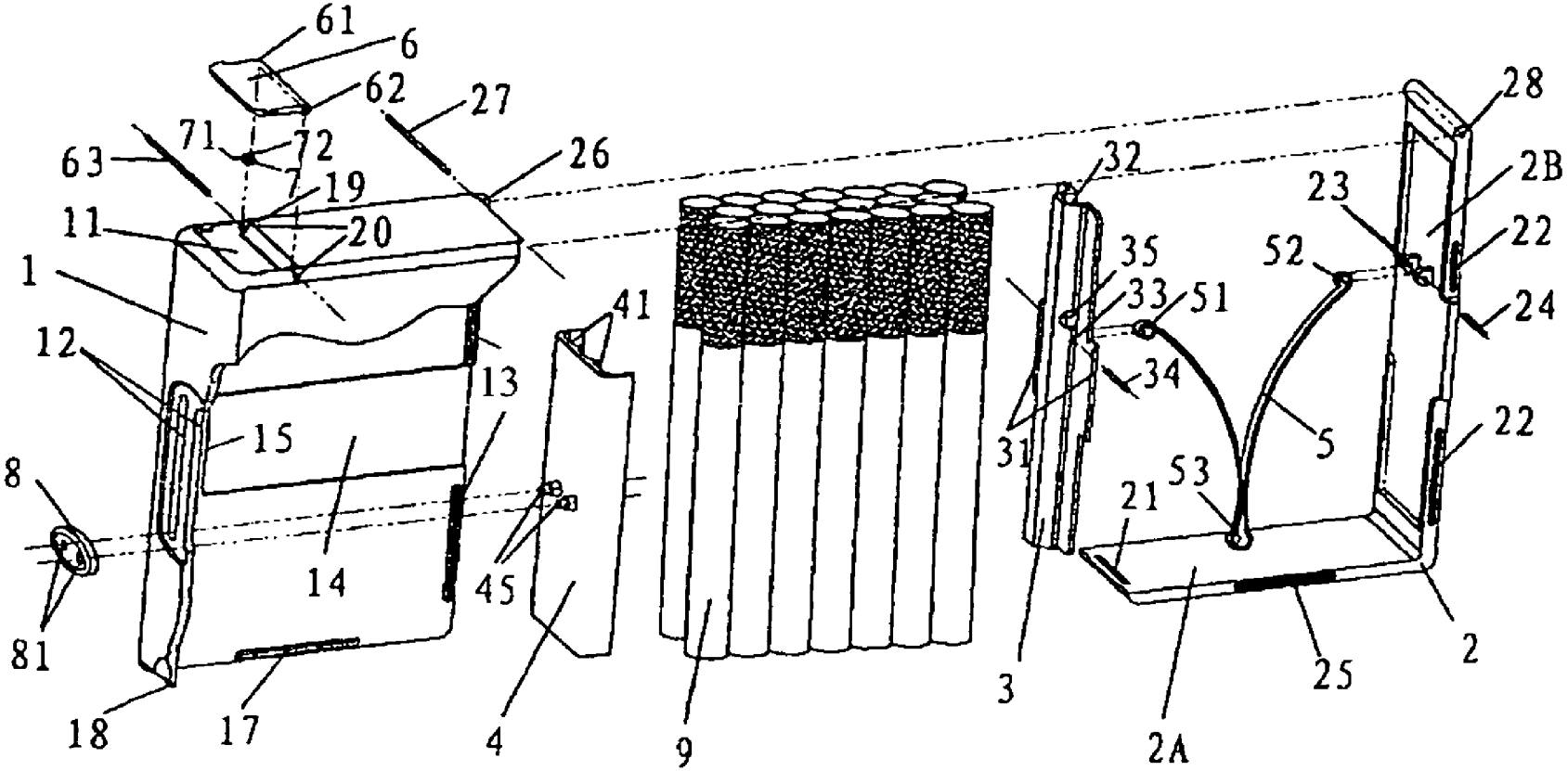
FIG. 2 is a view similar to FIG. 1 but viewed from an opposite angle.
Figure 3:
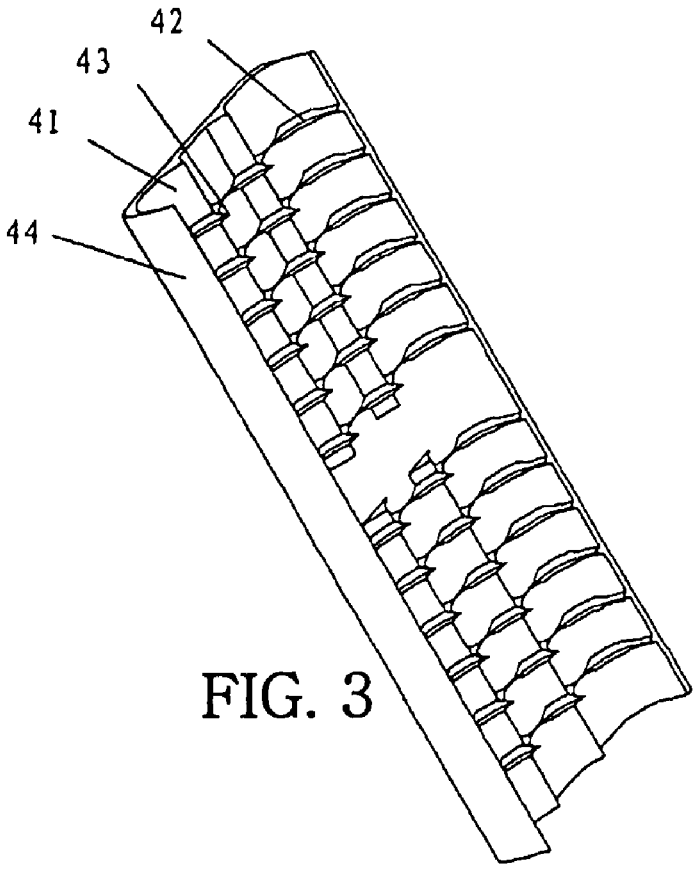
FIG. 3 is a perspective view of the first pusher.
Figure 4:
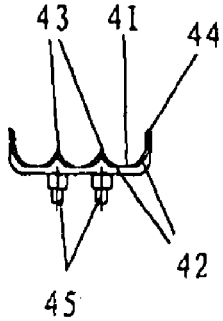
FIG. 4 is a top plan view of the first pusher.
Figure 5:
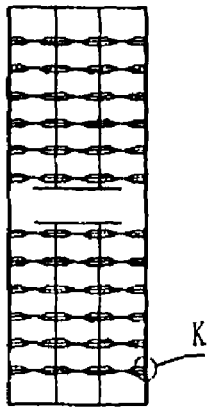
FIG. 5 is a side elevation of the first pusher.
Figure 6:
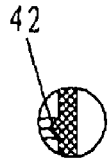
FIG. 6 is a detailed view of the area in circle K of FIG. 5.
Figure 7:
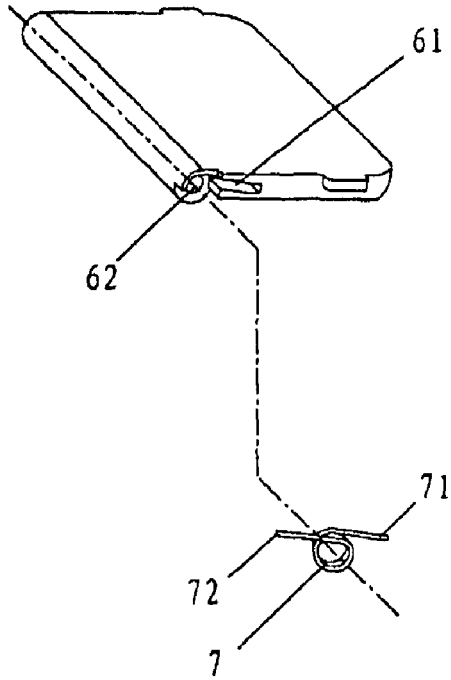
FIG. 7 is an enlarged view of the ejector lid and the torsion spring of FIG. 1.
Figure 8:
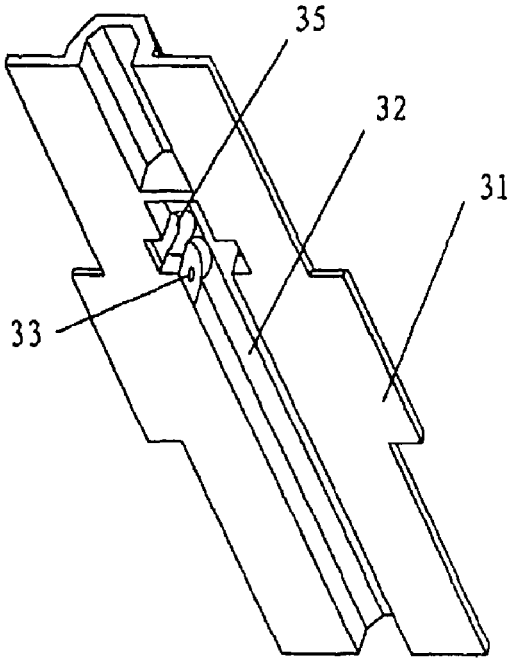
FIG. 8 is a perspective view of the second pusher.
Figure 9:
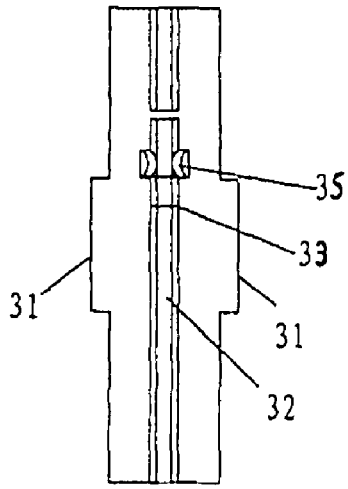
FIG. 9 is a side elevation of the second pusher.
Figure 10:
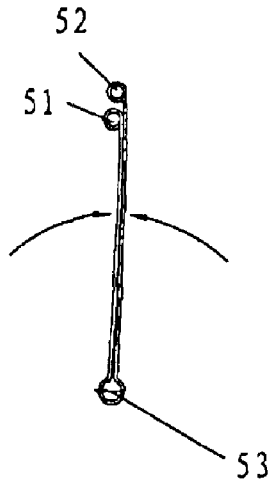
FIG. 10 is a side elevation of the V-shaped member compressed as an I-shaped one.
Figure 11:
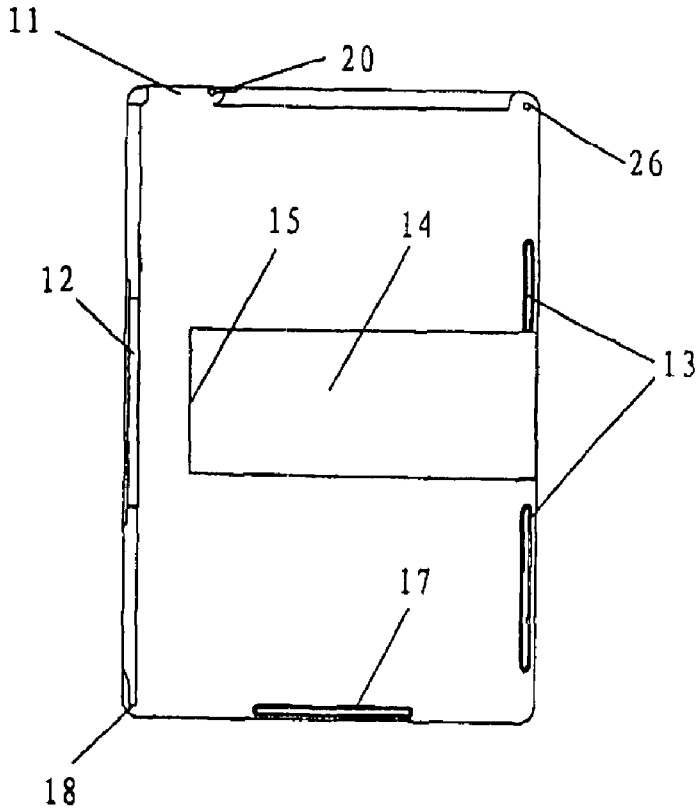
FIG. 11 is a longitudinal sectional view of the outer casing of FIG. 2.
Figure 12:
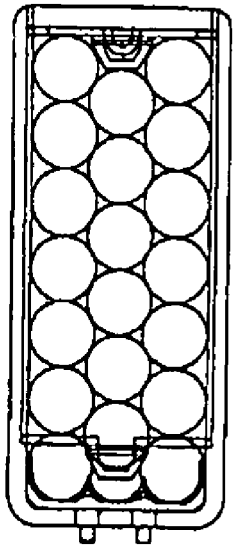
FIG. 12 is a top plan view of the assembled cigarette case with its top being removed to show fully packed cigarettes therein.

Referring to FIGS. 1 to 21, a cigarette case in accordance with the invention comprises an outer casing 1 having one open side and an open bottom. The outer casing 1 comprises a rectangular opening 11 at one end of the top, two parallel slots 12 at an intermediate portion of the other side, a rectangular recess 14 on an inner surface of either rear wall or front wall extending from one side to terminate at either stop shoulder 15 proximate the slots 12, two sets of two spaced first troughs 13 in which the recess 14 is formed between the first troughs 13 of either set and the first troughs 13 of the same set are formed on the front or rear edge of one side, two second troughs 17 each at the bottom of the inner surface of either the rear wall or the front wall, a first tab 18 at the bottom of the other side, a first hole 19 on the top in communication with the opening 11, two first through holes 20 at both corners of the opening 11 distal the other side of the opening 11 with the first hole 19 formed therebetween, and two second holes 26 at both ends of one top corner.

The cigarette case further comprises a first pusher 4 having a transverse section of U. For example, the first pusher 4 of the first preferred embodiment comprises three longitudinal grooves 41 substantially having a transverse section of half-circle in which one side 44 of either side groove 41 further extends a predetermined distance so as to have a length greater than a radius of a cigarette 9 contained therein, a plurality of spaced, transverse, arcuate ribs 42 longitudinally formed on each groove 411, a longitudinal ridge 43 formed between two adjacent grooves 41, and two flush second tabs 45 on an outer surface adapted to slidably pass the slots 12 to project out of the other side of the outer casing 1. By configuring as above, it is possible of preventing the contained cigarettes 9 from engaging the inner surfaces of the outer casing 1 so as to facilitate movement in the outer casing 1 and increasing friction between the cigarettes 9 and the grooves 41 so as to prevent the cigarettes 9 from vibrating. Both features can facilitate a smooth cigarette dispensing as detailed later.

The cigarette case further comprises a disc-shaped trigger member 8 having two flush third holes 81 adapted to lockingly receive the second tabs 45 so that the first pusher 4 can slide upward or downward by pulling up or pressing down the trigger member 8 as detailed later.

The cigarette case further comprises an ejector lid 6 dimensioned and shaped to fit snugly on the opening 11. The rectangular ejector lid 6 comprises a first channel 62 along one side, and a slit 61 opposing the first hole 19; a torsion spring 7 having one end 71 inserted into the slit 61 and retained therein, and the other end 72 inserted into the first hole 19 and retained therein; and a first pin 63 inserted through the first through holes 20, the first channel 62 and the torsion spring 7 to mount the ejector lid 6 as a hinged one which is adapted to open or close by rotating about the first pin 63 with the torsion spring 7 always trying to pull the open ejector lid 6 back to its original closed position as detailed later. Also, the ends 71, 72 of the torsion spring 7 are easy to rotate around the center line of the torsion spring 7 so that the cigarettes 9 can be easily dispensed by opening the ejector lid 6.

The cigarette case further comprises a cross-shaped second pusher 3 including two rectangular wings 31, a central, longitudinal, interrupted furrow 32, an intermediate, transverse cavity 35 parallel with the wings 31 and crossing the furrow 32, and two second through holes 33 at both sides of the furrow 32 substantially abutting the cavity 35.

The cigarette case further comprises an L-shaped cover 2 including a bottom 2A, a wall 2B perpendicular to the bottom 2A, and a second channel 28 on a top of the wall 2B. The cover 2 further comprises two flush ears 23 having a third through hole (not numbered) raised on an inner surface of the wall 2B, a slit 21 on an inner surface of the bottom 2A proximate the open end of the bottom 2A, two opposite third tabs 25 on intermediate portions of front and rear sides of the bottom 2A respectively, and two sets of two spaced fourth tabs 22 on front and rear sides of the wall 2B respectively.

The cigarette case further comprises a resilient V-shaped member 5 including a hollow first cylinder 51 at a first end, a hollow second cylinder 52 at an opposing second end, and a hollow third cylinder 53 at a joining point of both cylinders 51, 52.

The first cylinder 51 is fitted in the cavity 35 so that inserting a second pin 34 through the second through holes 33 and the first cylinder 51 will allow the first cylinder 51 to pivot a limited angle with respect to the second pin 34. The second cylinder 52 is fitted between the ears 23 so that inserting a third pin 24 through the third through holes of the ears 23 and the second cylinder 52 will allow the second cylinder 52 to pivot a limited angle with respect to the third pin 24. Further, inserting a fourth pin 27 through the second channel 28 into the second holes 26 will mount the cover 2 as a hinged one with respect to the outer casing 1.

In an assembly state of the cigarette case the first tab 18 is inserted into the slit 21 for releasably fastening therein, the third tabs 25 are inserted into the second troughs 17 for releasably fastening therein, and the fourth tabs 22 are inserted into the first troughs 13 for releasably fastening therein. Further, the second pusher 3 is adapted to slide substantially from a first position proximate the wall 2B to a second position coincident at the stop shoulders 15 (i.e., when the wings 31 slidable relative to the recess 14 are stopped by the stop shoulders 15 in its sliding movement) or vice versa.

By configuring as above, for example, a pushing of the cigarettes 9 toward the second pusher 3 will push one arm (i.e., the portion of the V-shaped member 5 from the first cylinder 51 to the third cylinder 53) of the V-shaped member 5 toward the wall 2B and push the other arm (i.e., the portion of the V-shaped member 5 from the second cylinder 52 to the third cylinder 53) of the V-shaped member 5 toward the second pusher 3 when packing cigarettes 9 in a space defined by the first pusher 4 and the second pusher 3.

Figure 21:
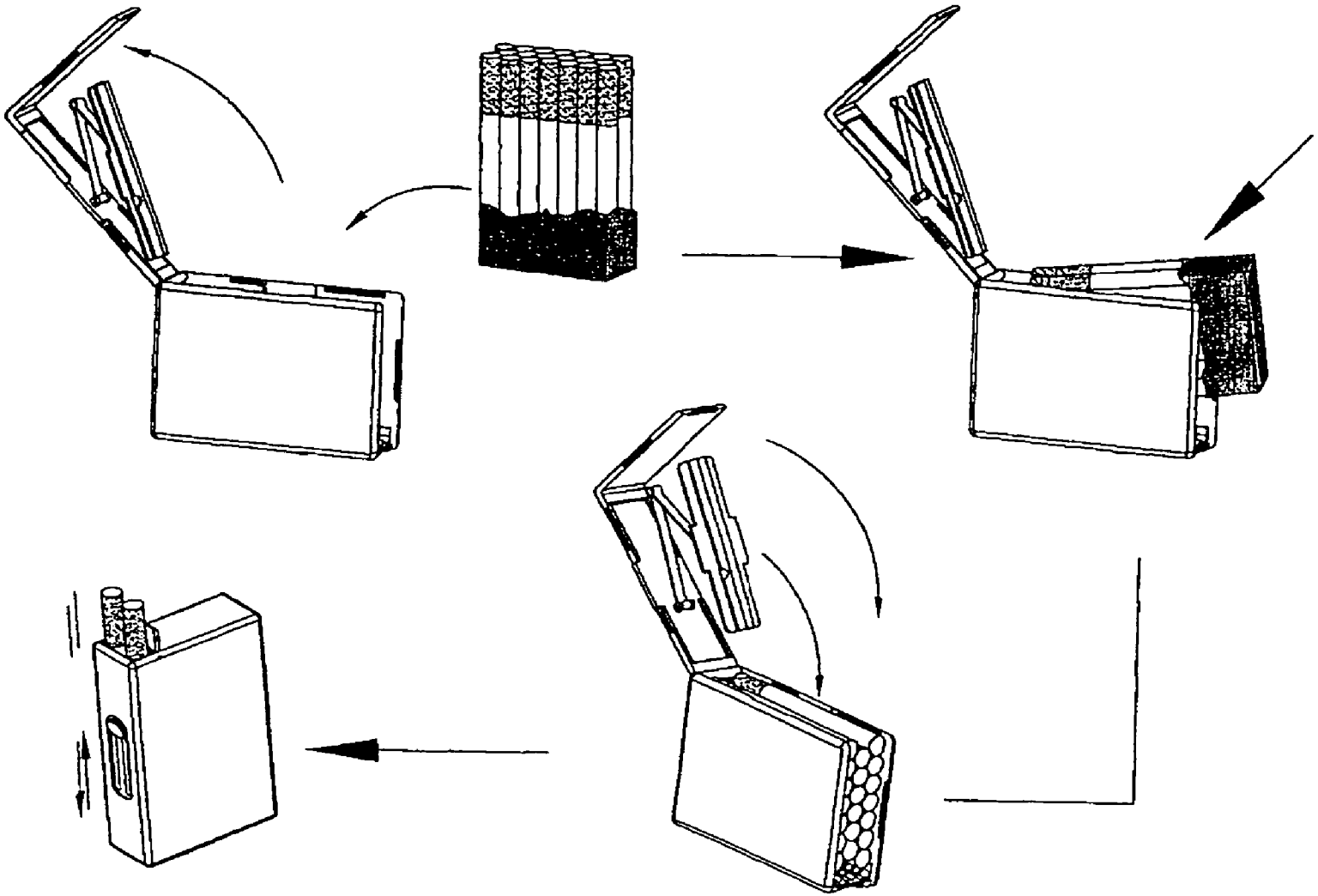
FIG. 21 depicts steps of packing cigarettes in the cigarette case of the invention and dispensing same.

A cigarette packing operation of the invention will be described in detail below by referring to FIG. 21 specifically. First, open the cover 2. Next, remove about two-thirds of a cigarette package to expose most portions of cigarettes 9. Next, pack the cigarettes 9 in the space defined by the second pusher 3 and the first pusher 4 by pushing the second pusher 3 toward the wall 2B and pushing the first pusher 4 toward the other side of the outer casing 1 until the wings 31 are stopped by the stop shoulders 15. Finally, close the cover 2 onto the outer casing 1.

Figure 18:
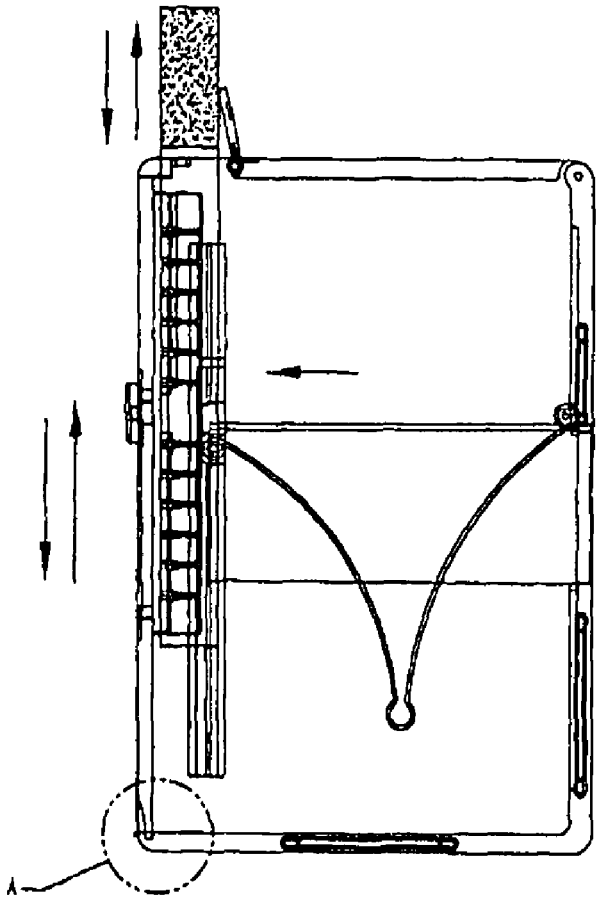
FIG. 18 is a longitudinal sectional view of the assembled cigarette case of FIG. 2 for showing a cigarette dispensing operation.
Figure 19:
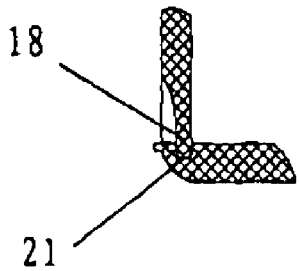
FIG. 19 is a detailed view of the area in circle A of FIG. 18.
Figure 20:
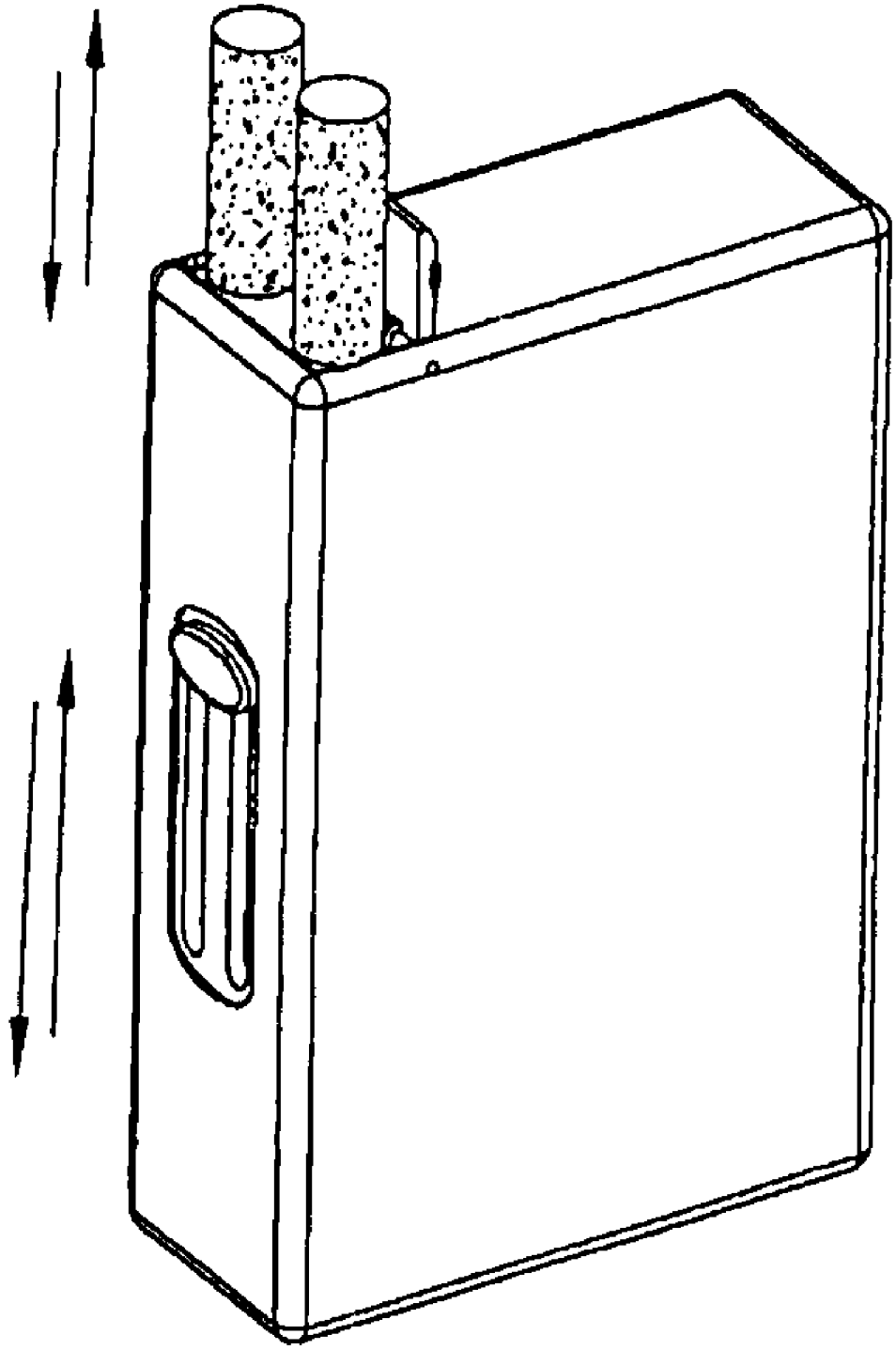
FIG. 20 is a perspective view of the cigarette case of FIG. 18.

A cigarette dispensing operation of the invention will be described in detail below by referring to FIGS. 18 and 20 specifically. First, pull up the trigger member 8 and thus the first pusher 4 until the trigger member 8 is stopped by the top ends of the slots 12. The upward moving cigarettes (e.g., two cigarettes) 9 will push the ejector lid 6 upward by pivoting about the torsion spring 7 until the filter portions of the cigarettes 9 are exposed. After removing the two cigarettes 9, the next two adjacent cigarettes 9 will occupy the empty space previously occupied by the removed cigarettes 9 as a result of pushing the cigarettes 9 toward the first pusher 4 by the second pusher 3 which is in turn pushed by the V-shaped member 5. A person may then press the trigger member 8 downward to return to its original position in which the next two cigarettes 9 are retained in the grooves 41 again. As an end, the ejector lid 6 automatically closes the opening 11 due to the exertion of the returning force of the torsion spring 7.

Figure 13:
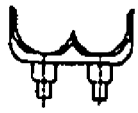
FIG. 13 is a top plan view of a second preferred embodiment of first pusher according to the invention.
Figure 14:
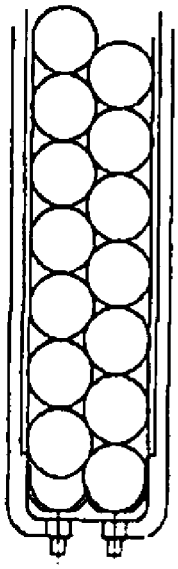
FIG. 14 is a top plan view of the assembled cigarette case incorporating the second preferred embodiment of first pusher with its top being removed to show fully packed cigarettes therein.

Referring to FIGS. 13 and 14 specifically, a second preferred embodiment of first pusher 4 according to the invention is shown. The characteristics of the second preferred embodiment of the first pusher 4 are that two rows of cigarettes 9 are adapted to pack in the space defined by the first pusher 4 and the second pusher 3 since the first pusher 4 has only two grooves 41. In comparison, the first pusher 4 of the first preferred embodiment has three grooves 41. Only one cigarette 9 can be removed in one dispensing operation.

Figure 15:
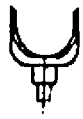
FIG. 15 is a top plan view of a third preferred embodiment of first pusher according to the invention.
Figure 16:
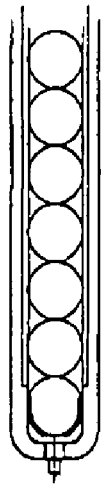
FIG. 16 is a top plan view of the assembled cigarette case incorporating the third preferred embodiment of first pusher with its top being removed to show fully packed cigarettes therein.
Figure 17:
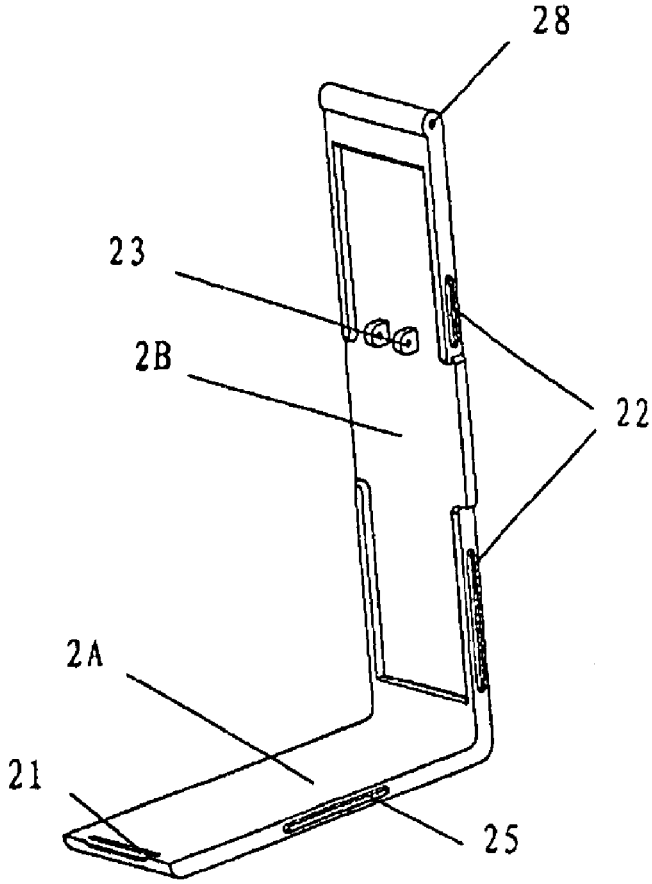
FIG. 17 is a perspective view of the cover.

Referring to FIGS. 15 and 16 specifically, a third preferred embodiment of first pusher 4 according to the invention is shown. The characteristics of the third preferred embodiment of the first pusher 4 are that one row of cigarettes 9 are adapted to pack in the space defined by the first pusher 4 and the second pusher 3 since the first pusher 4 has only one groove 41. Thus, only one cigarette 9 can be removed in one dispensing operation.

The cigarette case can be formed of a metal material or a non metal material.

While the invention herein disclosed has been described by means of specific embodiments, numerous modifications and variations could be made thereto by those skilled in the art without departing from the scope and spirit of the invention set forth in the claims.

What is claimed is:

1. A cigarette case comprising:

an outer casing having one open side and an open bottom and including an opening at a top end opposing the open bottom, two parallel slots on a side opposite the open side, a rectangular recess on an inner surface of either a rear wall or a front wall, the recess extending from the open side to a shoulder proximate the slots, and a snapping assembly;

a first pusher disposed in proximity to the side opposite the open side of the outer casing and having a U-shaped cross-section, the first pusher including at least one longitudinal groove having a substantially half-circular cross-section, and two flush tabs on an outer surface adapted to slidably pass the slots to project out of the outer casing;

a trigger member secured to the tabs;

a spring biased hinge-type ejector lid dimensioned and shaped to fit on the opening;

a cross-shaped second pusher including two rectangular wings adapted to slide from the open end of the recess to the shoulder or from the shoulder to the open end of the recess;

an L-shaped cover hingedly secured to a top corner of the outer casing and including a mated snapping assembly secured to the snapping assembly in a closed position of the cigarette case; and a resilient V-shaped member having a first end hingedly secured to the second pusher and a second end hingedly secured to the cover wherein the first and the second ends are adapted to resiliently move toward each other or away from each other;

wherein a plurality of cigarettes are adapted to be contained in a space defined between the at least one groove of the first pusher and the second pusher such that pulling up the trigger member a predetermined distance will lift the first pusher to cause the at least one cigarette engaged therewith to open the ejector lid.

2. The cigarette case of claim 1, wherein the snapping assembly comprises a plurality of first tabs and a plurality of first holes and the mated snapping assembly comprises a plurality of second tabs adapted to secure to the first holes, and a plurality of second holes adapted to secure to the first tabs.

3. The cigarette case of claim 1, wherein the at least one groove comprises three grooves.

4. The cigarette case of claim 3, wherein the upward pulling of the trigger member is adapted to expose two cigarettes.

5. The cigarette case of claim 1, wherein the at least one groove comprises two grooves.

6. The cigarette case of claim 5, wherein the upward pulling of the trigger member is adapted to expose one cigarette.

7. The cigarette case of claim 1, wherein the at least one groove comprises one groove.

8. The cigarette case of claim 7, wherein the upward pulling of the trigger member is adapted to expose one cigarette.

9. The cigarette case of claim 1, wherein the first pusher further comprises a plurality of spaced, transverse, arcuate ribs longitudinally formed on each of the at least one groove.

* * * * *